US012066239B2

(12) United States Patent
Liu et al.

(10) Patent No.: US 12,066,239 B2
(45) Date of Patent: Aug. 20, 2024

(54) DOOR BODY AND REFRIGERATOR WITH THE SAME

(71) Applicants: QINGDAO HAIER REFRIGERATOR CO., LTD., Shandong (CN); HAIER SMART HOME CO., LTD., Shandong (CN)

(72) Inventors: Wenlong Liu, Qingdao (CN); Mingming Ma, Qingdao (CN)

(73) Assignees: Qingdao Haier Refrigerator Co., Ltd., Qingdao (CN); Haier Smart Home Co., Ltd., Qingdao (CN)

( * ) Notice: Subject to any disclaimer, the term of this patent is extended or adjusted under 35 U.S.C. 154(b) by 168 days.

(21) Appl. No.: 17/780,594

(22) PCT Filed: Sep. 23, 2020

(86) PCT No.: PCT/CN2020/117102

§ 371 (c)(1),
(2) Date: May 27, 2022

(87) PCT Pub. No.: WO2021/103787

PCT Pub. Date: Jun. 3, 2021

(65) Prior Publication Data

US 2023/0003436 A1 Jan. 5, 2023

(30) Foreign Application Priority Data

Nov. 29, 2019 (CN) ..... 201911206381.8

(51) Int. Cl.
*F25D 23/02* (2006.01)

(52) U.S. Cl.
CPC ..... *F25D 23/025* (2013.01); *F25D 23/028* (2013.01); *F25D 2323/023* (2013.01)

(58) Field of Classification Search
CPC ..... F25D 23/025; F25D 23/028; F25D 2323/023; F25D 25/02; F25D 23/04
See application file for complete search history.

(56) References Cited

U.S. PATENT DOCUMENTS 10,126,040 B1 * 11/2018 Ribeiro ..... F25D 23/021
2006/0226750 A1 * 10/2006 Lee ..... F25D 23/02 312/405.1

(Continued)

FOREIGN PATENT DOCUMENTS

CN 102230713 A 11/2011
CN 202181794 U 4/2012

(Continued)

OTHER PUBLICATIONS

International Search Report for PCT/CN2020/117102 (ISA/CN) mailed Dec. 16, 2020 w/English translation.

(Continued)

*Primary Examiner* — Hiwot E Tefera
(74) *Attorney, Agent, or Firm* — Alston & Bird LLP

(57) ABSTRACT

Disclosed are a door body for a refrigerator and a refrigerator with the same. The refrigerator includes a cabinet defining a storage compartment with a compartment opening, and the door body includes an inner door, an outer door and a storage box. The inner door is arranged at a position corresponding to the compartment opening on an outer side of the storage compartment, and is used to open and close the compartment opening. The outer door is arranged at a side of the inner door away from the storage compartment. The storage box is fixed to a side of the inner door close to the storage compartment; one end of the storage box close to the outer door has a storage opening, and an area of the (Continued)

inner door corresponding to the storage opening is provided with an inner door opening. The door body reduces the loss of cooling energy.

7 Claims, 5 Drawing Sheets

(56) References Cited

U.S. PATENT DOCUMENTS

| | | | | |
|---|---|---|---|---|
| 2010/0257892 | A1* | 10/2010 | Lee | F25D 23/04 62/449 |
| 2011/0187255 | A1* | 8/2011 | Ryu | E05F 3/20 49/386 |
| 2011/0232317 | A1* | 9/2011 | Flores | F25D 23/04 62/320 |
| 2011/0315694 | A1* | 12/2011 | Kurita | F25D 23/025 220/592.09 |
| 2013/0081423 | A1* | 4/2013 | Kwon | F25D 23/028 62/449 |
| 2013/0111941 | A1 | 5/2013 | Yu et al. | |
| 2014/0132143 | A1* | 5/2014 | Kim | F25D 23/028 264/261 |
| 2014/0132144 | A1 | 5/2014 | Kim et al. | |
| 2017/0299255 | A1* | 10/2017 | Kim | F25D 23/025 |
| 2017/0350637 | A1* | 12/2017 | Kwon | F25D 23/025 |
| 2018/0328641 | A1* | 11/2018 | Lee | F25C 1/24 |
| 2018/0335246 | A1 | 11/2018 | Jeong et al. | |
| 2018/0347893 | A1* | 12/2018 | Karl | F25D 23/04 |
| 2018/0372394 | A1* | 12/2018 | Kim | F25D 11/00 |
| 2019/0024962 | A1 | 1/2019 | Lee et al. | |
| 2021/0285717 | A1* | 9/2021 | Gao | F25D 23/04 |

FOREIGN PATENT DOCUMENTS

| | | | | |
|---|---|---|---|---|
| CN | 102494480 | A | | 6/2012 |
| CN | 102564042 | A | * | 7/2012 |
| CN | 202757377 | U | | 2/2013 |
| CN | 103148663 | A | | 6/2013 |
| CN | 203216196 | U | | 9/2013 |
| CN | 204326881 | U | | 5/2015 |
| CN | 205174969 | U | | 4/2016 |
| CN | 205991664 | U | | 3/2017 |
| CN | 108036578 | A | | 5/2018 |
| CN | 110895069 | A | | 3/2020 |
| DE | 19802765 | A1 | | 7/1999 |
| KR | 10-2014-0123738 | A | | 10/2014 |
| KR | 10-2016-0023113 | A | | 3/2016 |
| WO | WO 2004059228 | A1 | | 7/2004 |

OTHER PUBLICATIONS

Supplementary European Search Report for EP Patent Application No. 20891596 dated Oct. 13, 2022 (4 pages).

1st Office Action for EP Patent Application No. 20891596.7 dated Oct. 26, 2022 (5 pages).

Notice of Intent to Grant European Patent for EP Application No. 20891596.7 dated Mar. 9, 2023 (24 pages).

Search Report for China Patent Application No. 2019112063818 dated Jul. 22, 2021 (2 pages).

Notice of Intent to Grant for China Patent Application No. 2019112063818 dated Aug. 4, 2021 (2 pages).

* cited by examiner

DOOR BODY AND REFRIGERATOR WITH THE SAME

CROSS-REFERENCE TO RELATED APPLICATIONS

The present application is a national phase entry of International Application No. PCT/CN2020/117102, filed Sep. 23, 2020, which claims priority to Chinese Patent Application No. 201911206381.8, filed Nov. 29, 2019, which are incorporated herein by reference in their entirety.

FIELD OF THE INVENTION

The present invention relates to the technical field of refrigeration equipment, and more particularly relates to a door body and a refrigerator with the same.

BACKGROUND OF THE INVENTION

With the development of social economy and the improvement of people's living standard, refrigerators have become an indispensable household appliance in people's daily life.

A door body of most existing refrigerators only includes a door main body for opening and closing a storage compartment, and this type of door body is easy to cause a leakage of the cooling energy of the storage compartment. The door bodies of a few of refrigerators have a door-in-door structure, and the door body of this type of refrigerators has an inner door for opening or closing a compartment opening of the storage compartment and an outer door arranged at a side of the inner door away from the storage compartment. These existing refrigerators are generally provided with a storage device on the outer door, so that articles in the storage device can be taken when the outer door is opened only.

However, when the outer door is opened, the storage device will move with the outer door, thereby causing the storage device to leave the storage compartment, which will reduce the fresh-keeping effect of the storage device on the food and increase the energy consumption of the refrigerator at the same time.

BRIEF DESCRIPTION OF THE INVENTION

In view of the above-mentioned problems, an invention is proposed in order to provide a door body and a refrigerator with the same that overcome the above-mentioned problems or at least partially solve the above-mentioned problems.

An objective of the present invention is to provide a refrigerator with a door-in-door structure that has a good fresh-keeping effect on food.

A further objective of the present invention is to make the structure of this type of door body more stable.

Another objective of the present invention is to provide a refrigerator with the above-mentioned door body.

The present invention first provides a door body for a refrigerator including a cabinet defining a storage compartment with a compartment opening. The door body includes: an inner door, arranged at a position corresponding to the compartment opening on an outer side of the storage compartment, the inner door being used to open and close the compartment opening; an outer door, arranged at a side of the inner door away from the storage compartment; and a storage box, fixed to a side of the inner door close to the storage compartment, one end of the storage box close to the outer door having a storage opening, and an area of the inner door corresponding to the storage opening being provided with an inner door opening.

Optionally, the door body further includes: an opening and closing member, arranged at the storage opening and used to open and close the storage opening.

Optionally, the door body further includes two pins arranged at the opening and closing member; the inner door is provided with a pin hole for accommodating a corresponding pin in an area corresponding to each pin of the two pins, so that the opening and closing member is pivotably arranged at the storage opening.

Optionally, at least one pin of the two pins includes: a cylindrical body, a first end of which is arranged at a corresponding pin hole, and a second end of which is provided with a positioning part extending along a circumferential direction of the cylindrical body; and a clamping protrusion, arranged at a surface of the cylindrical body located between the first end and the positioning part. Two ends of the opening and closing member are respectively provided with connecting holes in areas opposite to the corresponding pins, and the connecting hole is used to connect the cylindrical body between the positioning part and the clamping protrusion of the corresponding pin.

Optionally, at least one pin of the two pins includes: at least one guide protrusion, each guide protrusion extending along a radial direction of the cylindrical body from the cylindrical body between the positioning part and the clamping protrusion; and a hole wall of the connecting hole is provided with a guide groove adapted to the guide protrusion.

Optionally, the at least one guide protrusion is a plurality of guide protrusions evenly distributed at intervals along the circumferential direction of the cylindrical body.

Optionally, an area on an outer surface of the storage box corresponding to the inner door is provided with at least one clamping groove; and an area of the inner door corresponding to the at least one clamping groove is provided with at least one fixing protrusion corresponding to and adapted to the at least one clamping groove one by one.

Optionally, the at least one clamping groove includes two clamping grooves in opposite directions.

Optionally, the inner door includes: a door frame, a middle part of which defines an installation space; and a heat insulation board, arranged at the installation space, the storage box being fixed to a side of the heat insulation board close to the storage compartment.

The present invention further provides a refrigerator, including: a cabinet, in which a storage compartment with a compartment opening is defined; and any one of the door bodies described above.

The present invention provides a door body for a refrigerator and a refrigerator with the same. The refrigerator includes a cabinet, defining a storage compartment with a compartment opening, and the door body includes an inner door, an outer door and a storage box. The inner door is arranged at a position corresponding to the compartment opening on an outer side of the storage compartment, and the inner door is used to open and close the compartment opening. The outer door is arranged at a side of the inner door away from the storage compartment. The storage box is fixed to a side of the inner door close to the storage compartment; one end of the storage box close to the outer door has a storage opening, and an area of the inner door corresponding to the storage opening is provided with an inner door opening. This type of door body enables a user to take and place food in the storage box by just opening the outer door, which reduces the loss of the cooling energy, and the storage box does not move with the outer door, so that the cooling energy of the refrigerator can still keep the food in the storage box fresh, which improves the fresh-keeping effect on the food in the storage box and reduces the energy consumption of the refrigerator at the same time.

Further, at least one pin includes a cylindrical body and a clamping protrusion. A first end of the cylindrical body is arranged at a corresponding pin hole, and a second end of the cylindrical body is provided with a positioning part extending along a circumferential direction of the cylindrical body. The clamping protrusion is arranged at a surface of the cylindrical body located between the first end and the positioning part. Furthermore, two ends of the opening and closing member are respectively provided with connecting holes in areas opposite to corresponding pins, and the connecting hole is used to connect the cylindrical body between the positioning part and the clamping protrusion of the corresponding pin. Such arrangement makes the connection between the pin and the opening and closing member stronger, thereby making the structure of this type of door body more stable.

According to the following detailed descriptions of specific embodiments of the present invention in conjunction with the drawings, those skilled in the art will more clearly understand the above and other objectives, advantages and features of the present invention.

BRIEF DESCRIPTION OF THE DRAWINGS

Some specific embodiments of the present invention are described in detail below in an exemplary rather than limited manner with reference to the drawings. The same reference numerals in the drawings indicate the same or similar components or parts. Those skilled in the art should understand that these drawings are not necessarily drawn to scale. In the drawings.

DETAILED DESCRIPTION

Figure 1:
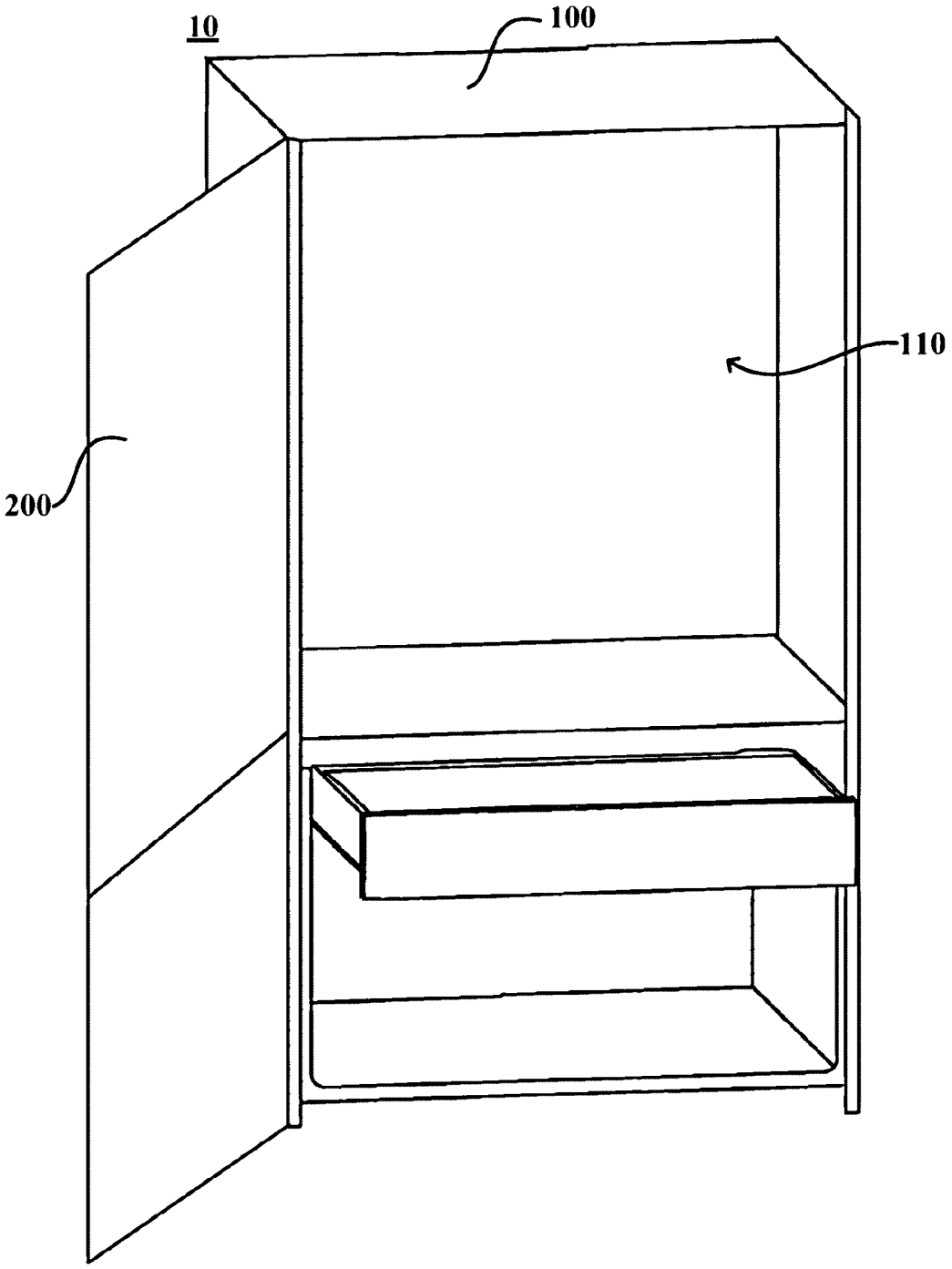
FIG. 1 is a schematic structural diagram of a refrigerator according to an embodiment of the present invention.
Figure 2:
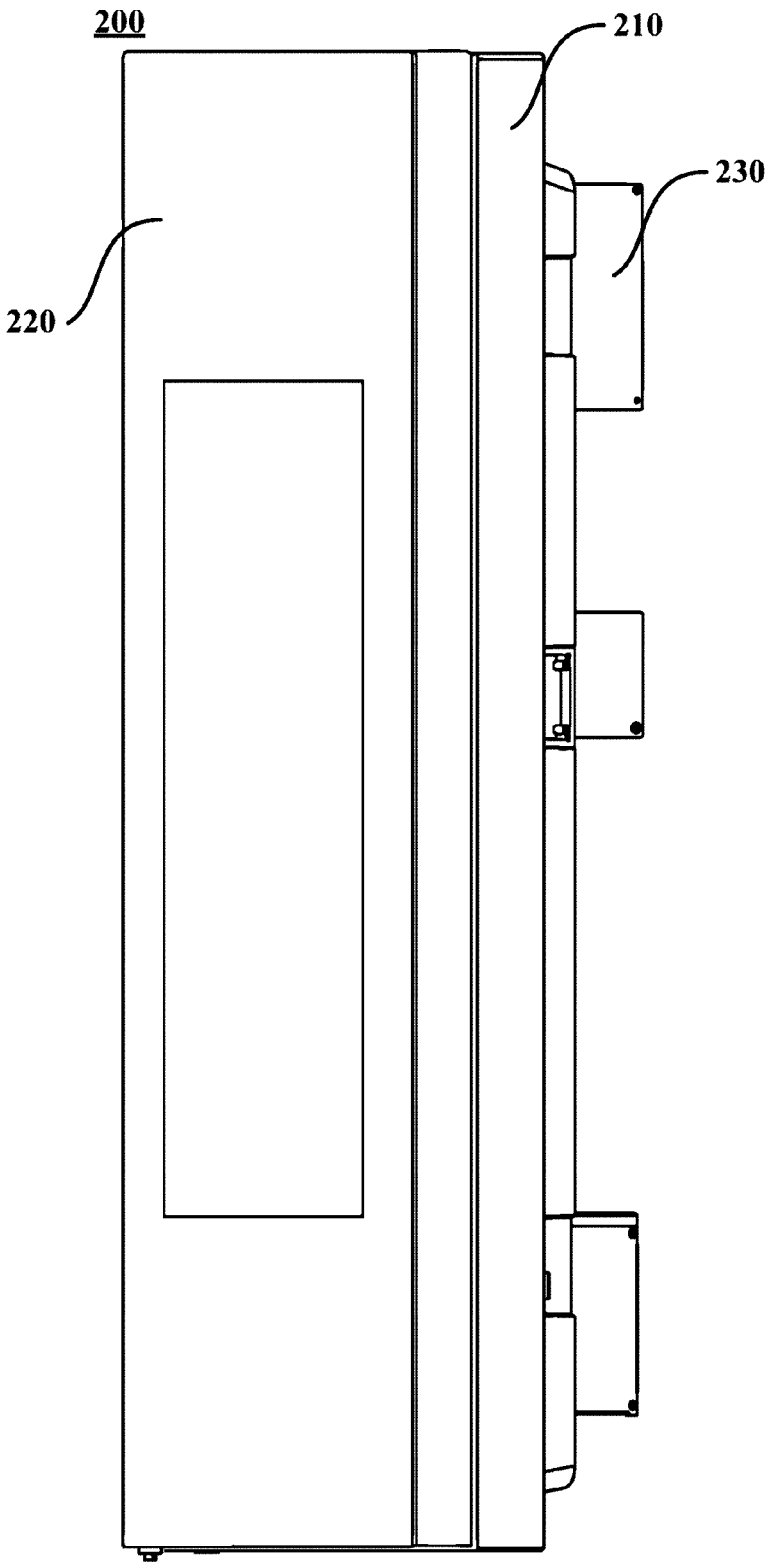
FIG. 2 is a schematic structural diagram of a door body according to an embodiment of the present invention.
Figure 3:
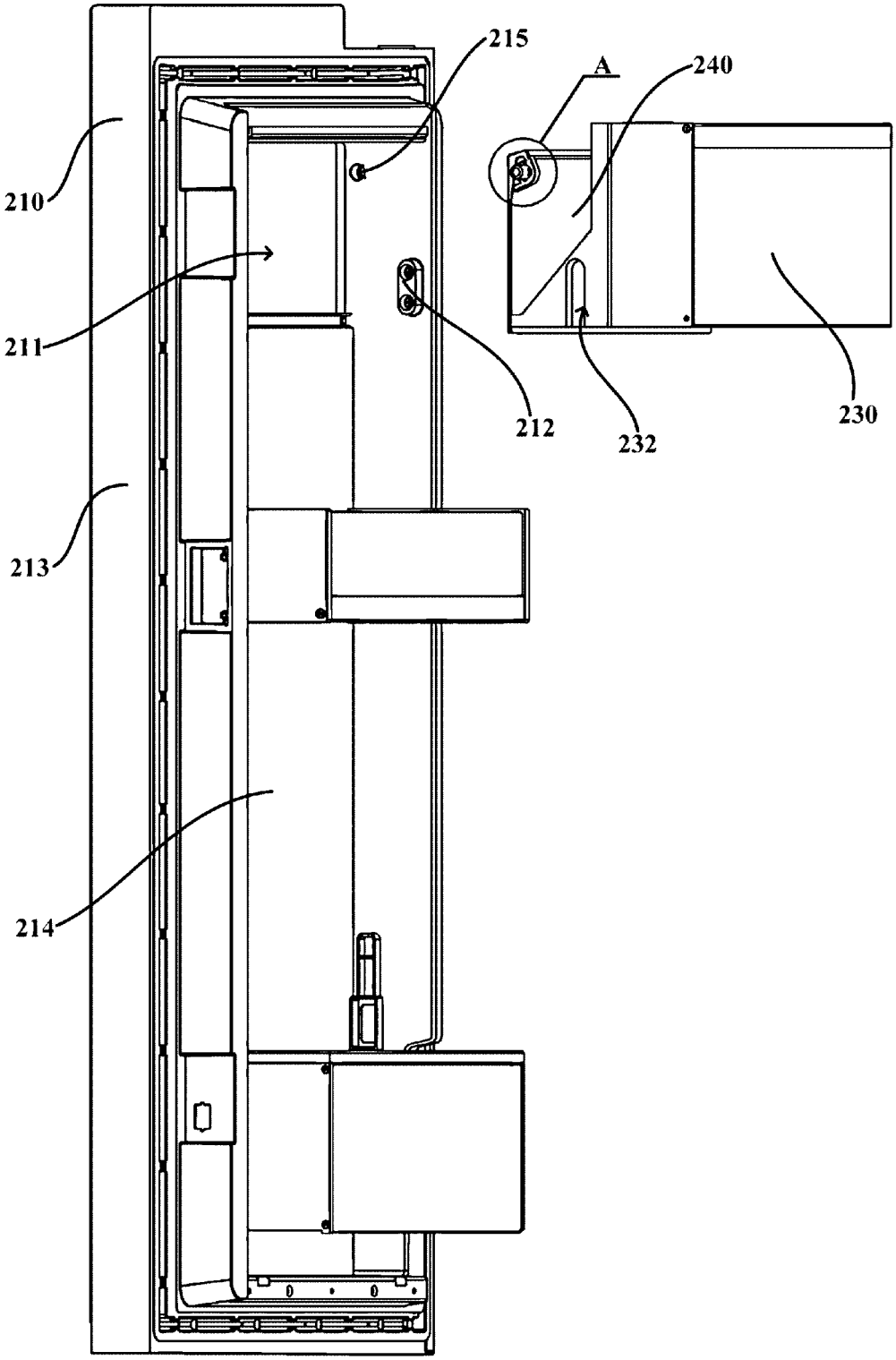
FIG. 3 is an exploded view of a door body without an outer door according to an embodiment of the present invention.
Figure 4:
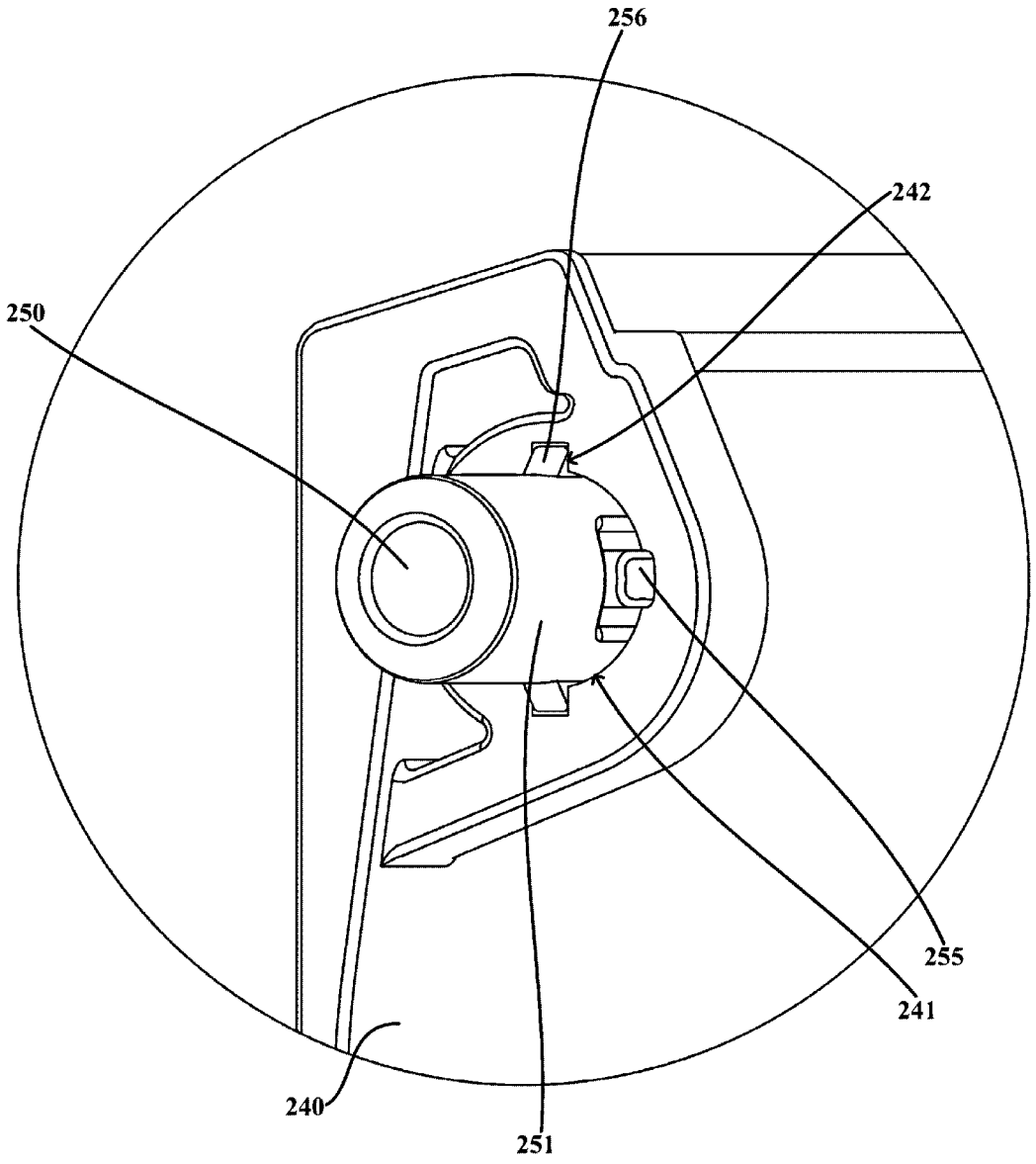
FIG. 4 is a partial enlarged view of an area A shown in FIG. 3.

The present embodiment first provides a door body 200 for a refrigerator 10. The refrigerator 10 includes a cabinet 100 defining a storage compartment 110 with a compartment opening (specifically, the cabinet 100 defines a storage compartment 110 with a forward compartment opening). FIG. 1 is a schematic structural diagram of the refrigerator 10 according to an embodiment of the present invention. FIG. 2 is a schematic structural diagram of the door body 200 according to an embodiment of the present invention. FIG. 3 is an exploded view of the door body 200 without an outer door 220 according to an embodiment of the present invention. FIG. 4 is a partial enlarged view of an area A shown in FIG. 3.

The door body 200 includes an inner door 210, an outer door 220 and a storage box 230.

The inner door 210 is arranged at a position corresponding to the compartment opening on an outer side of the storage compartment 110 (specifically, the inner door 210 is arranged at a position corresponding to the compartment opening on a front side of the storage compartment 110), and the inner door 210 is used to open and close the compartment opening. The outer door 220 is arranged at a side of the inner door 210 away from the storage compartment 110. This type of door body 200 with the inner door 210 and the outer door 220 is generally referred to as a door-in-door, which can reduce the consumption of the cooling energy in the refrigerator 10 and improve the fresh-keeping effect on food.

The storage box 230 is fixed to a side of the inner door 210 close to the storage compartment 110, and the storage box 230 can improve the space utilization rate of the refrigerator 10.

One end of the storage box 230 close to the outer door 220 has a storage opening, and an area of the inner door 210 corresponding to the storage opening is provided with an inner door opening 211, so that a user can take the food stored in the storage box 230.

This type of door body 200 enables a user to take and place the food in the storage box 230 by just opening the outer door 220, which reduces the loss of the cooling energy, and the storage box 230 does not move with the outer door 220, so that the cooling energy of the refrigerator 10 can still keep the food in the storage box 230 fresh, which improves the fresh-keeping effect on the food in the storage box 230 and reduces the energy consumption of the refrigerator 10 at the same time.

The door body 200 may further includes an opening and closing member 240, and the opening and closing member 240 is arranged at the storage opening and used to open and close the storage opening. The opening and closing member 240 can avoid a leakage of the cooling energy in the storage box 230 when the inner door 210 and the outer door 220 are closed at the same time, thereby improving the fresh-keeping effect on the food in the storage box 230.

The door body 200 may further include two pins 250 arranged at the opening and closing member 240 (specifically, the two pins 250 are arranged at two lateral ends of the opening and closing member 240). The inner door 210 is provided with a pin hole 215 for accommodating a corresponding pin 250 in an area corresponding to each pin 250 of the two pins 250, so that the opening and closing member 240 is pivotably arranged at the storage opening.

The mode that the opening and closing member 240 is pivotably arranged at the storage opening by means of the pins 250 has the advantages of simple structure, convenient operation and low cost.

Figure 5:
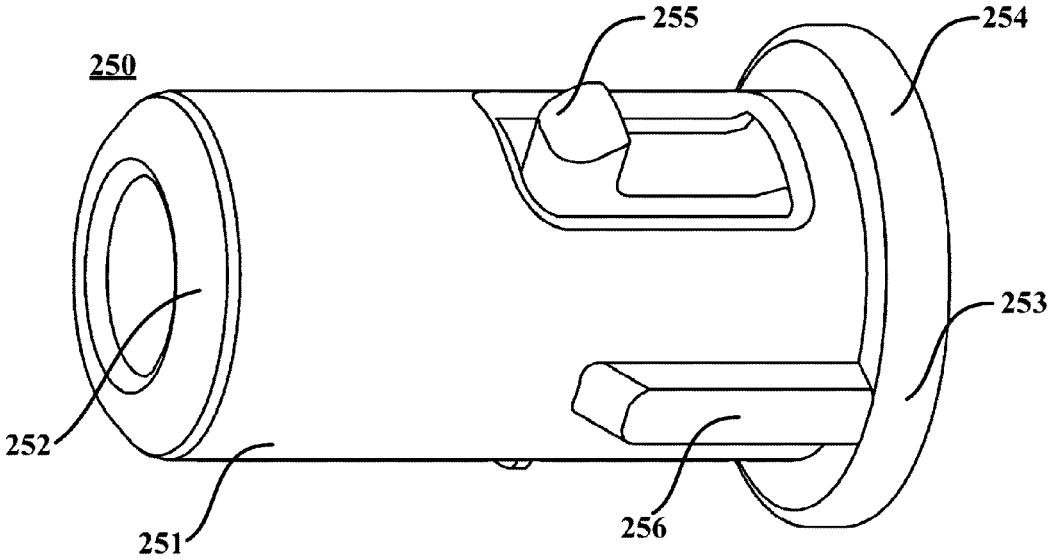
FIG. 5 is a schematic structural diagram of a pin of the door body according to an embodiment of the present invention.

At least one pin 250 of the two pins 250 includes a cylindrical body 251 and a clamping protrusion 255. FIG. 5 is a schematic structural diagram of a pin 250 of the door body 200 according to an embodiment of the present invention.

A first end 252 of the cylindrical body 251 is arranged at a corresponding pin hole 215, and a second end 253 of the cylindrical body 251 is provided with a positioning part 254 extending along a circumferential direction of the cylindrical body 251.

The clamping protrusion 255 is arranged at a surface of the cylindrical body 251 located between the first end 252 and the positioning part 254.

Furthermore, two ends of the opening and closing member 240 are respectively provided with connecting holes 241 in areas opposite to corresponding pins 250, and the connecting hole 241 is used to connect the cylindrical body 251 between the positioning part 254 and the clamping protrusion 255 of the corresponding pin 250.

Such arrangement makes the connection between the pins 250 and the opening and closing member 240 stronger, thereby making the structure of this type of door body 200 more stable.

At least one pin 250 of the two pins 250 includes at least one guide protrusion 256.

Each guide protrusion 256 extends along a radial direction of the cylindrical body 251 from the cylindrical body 251 between the positioning part 254 and the clamping protrusion 255.

Furthermore, a hole wall of the connecting hole 241 is provided with a guide groove 242 adapted to the guide protrusion 256. The cooperation of the guide protrusion 256 and the guide groove 242 facilitates the assembly of the pins 250, improves the production efficiency of this type of door body 200, and facilitates the pivoting of the opening and closing member 240.

The at least one guide protrusion 256 is a plurality of guide protrusions 256 evenly distributed at intervals along the circumferential direction of the cylindrical body 251. The plurality of guide protrusions 256 evenly distributed at intervals along the circumferential direction of the cylindrical body 251 are more convenient for the pivoting of the opening and closing member 240, and can avoid the damage of the guide groove 242.

An area on an outer surface of the storage box 230 corresponding to the inner door 210 is provided with at least one clamping groove 232. Furthermore, an area of the inner door 210 corresponding to the at least one clamping groove 232 is provided with at least one fixing protrusion 212 corresponding to and adapted to the at least one clamping groove 232 one by one.

The tightness of the connection between the storage box 230 and the inner door 210 can be improved by the cooperation of the clamping groove 232 and the fixing protrusion 212.

The at least one clamping groove 232 includes two clamping grooves 232 in opposite directions to further improve the tightness of the connection between the storage box 230 and the inner door 210.

The inner door 210 may include a door frame 213 and a heat insulation board 214. A middle part of the door frame 213 defines an installation space. The heat insulation board 214 is arranged at the installation space, and the storage box 230 is fixed to a side of the heat insulation board 214 close to the storage compartment 110. The heat insulation board 214 can improve the heat preservation performance of the storage compartment 110. The door frame 213 is used to connect with the cabinet 100 and fix the heat insulation board 214. Since the heat insulation board 214 is arranged at the installation space in the middle part of the door frame 213, fixedly arranging the storage box 230 at the heat insulation board 214 can facilitate the user operation and improve the user experience.

In some embodiments, the storage box 230 may be fixedly arranged at an upper area of the heat insulation board 214 to improve the space utilization rate, and one or more bottle holders may be arranged at intervals under the storage box 230 to facilitate the user to store food.

In some embodiments, the storage box 230 and the opening and closing member 240 may define a sealed storage box space, so as to meet the user's requirements for storage of special food material and improve the user experience.

The present embodiment further provides a refrigerator 10. The refrigerator 10 includes a cabinet 100 and any one of the door bodies 200 described above, wherein a storage compartment 110 with a compartment opening is defined in the cabinet 100.

The storage compartment 110 may include a refrigerating compartment, a freezing compartment and a temperature-variable compartment. As is well known to those skilled in the art, the temperature in the refrigerating compartment is generally between 2° C. and 10° C., preferably between 4° C. and 7° C. The temperature in the freezing compartment generally ranges from −22° C. to −14° C. The temperature-variable compartment may be adjusted between −18° C. and 8° C. at will. The best storage temperatures for different types of articles are not the same, and the suitable storage locations thereof are not the same, either. For example, fruit and vegetable foods are suitable to be stored in the refrigerating compartment, while meat foods are suitable to be stored in the freezing compartment. The door body 200 may be a refrigerating compartment door body for opening and closing the refrigerating compartment, a freezing compartment door body for opening and closing the freezing compartment, or a temperature-variable compartment door body for opening and closing the temperature-variable compartment.

A refrigeration system is configured to provide cooling energy to the storage compartment 110. The refrigeration system may be a refrigeration cycle system composed of a compressor, a condenser, a throttling device, an evaporator, and the like, and may alternatively be a semiconductor refrigeration system. Since the refrigeration principle of the refrigerator 10 is well known to those skilled in the art, the descriptions thereof are omitted herein.

The present embodiment provides a door body 200 for a refrigerator 10 and a refrigerator 10 with the same. The refrigerator 10 includes a cabinet 100 defining a storage compartment 110 with a compartment opening, and the door body 200 includes an inner door 210, an outer door 220 and a storage box 230. The inner door 210 is arranged at a position corresponding to the compartment opening on an outer side of the storage compartment 110, and the inner door 210 is used to open and close the compartment opening. The outer door 220 is arranged at a side of the inner door 210 away from the storage compartment 110. The storage box 230 is fixed to a side of the inner door 210 close to the storage compartment 110, one end of the storage box 230 close to the outer door 220 has a storage opening, and an area of the inner door 210 corresponding to the storage opening is provided with an inner door opening 211. This type of door body 200 enables a user to take and place the food in the storage box 230 by just opening the outer door 220, which reduces the loss of the cooling energy, and the storage box 230 does not move with the outer door 220, so that the cooling energy of the refrigerator 10 can still keep the food in the storage box 230 fresh, which improves the fresh-keeping effect on the food in the storage box 230 and reduces the energy consumption of the refrigerator 10 at the same time.

At least one pin 250 may include a cylindrical body 251 and a clamping protrusion 255. A first end 252 of the cylindrical body 251 is arranged at a corresponding pin hole 215, and a second end 253 of the cylindrical body 251 is provided with a positioning part 254 extending along a circumferential direction of the cylindrical body 251. The clamping protrusion 255 is arranged at a surface of the cylindrical body 251 located between the first end 252 and the positioning part 254. Furthermore, two ends of the opening and closing member 240 are respectively provided with connecting holes 241 in areas opposite to corresponding pins 250, and the connecting hole 241 is used to connect the cylindrical body 251 between the positioning part 254 and the clamping protrusion 255 of the corresponding pin 250. Such arrangement makes the connection between the pin 250 and the opening and closing member 240 stronger, thereby making the structure of this type of door body 200 more stable.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and deemed to cover all such other variations or modifications.

What is claimed is:

1. A door body for a refrigerator, the refrigerator comprising a cabinet defining a storage compartment with a compartment opening, the door body comprising:

an inner door, arranged at a position corresponding to the compartment opening on an outer side of the storage compartment, the inner door being used to open and close the compartment opening;

an outer door, arranged at a side of the inner door away from the storage compartment;

a storage box, fixed to a side of the inner door close to the storage compartment, one end of the storage box close to the outer door having a storage opening, and an area of the inner door corresponding to the storage opening being provided with an inner door opening an opening and closing member, arranged at the storage opening and used to open and close the storage opening; and two pins arranged at the opening and closing member, wherein the inner door is provided with a pin hole for accommodating a corresponding pin in an area corresponding to each pin of the two pins, so that the opening and closing member is pivotably arranged at the storage opening, at least one pin of the two pins comprises:

a cylindrical body, a first end of which is arranged at a corresponding pin hole, and a second end of which is provided with a positioning part extending along a circumferential direction of the cylindrical body; and a clamping protrusion, arranged at a surface of the cylindrical body located between the first end and the positioning part; and two ends of the opening and closing member are respectively provided with connecting holes in areas opposite to corresponding pins, the connecting hole being used to connect the cylindrical body between the positioning part and the clamping protrusion of the corresponding pin.

2. The door body according to claim 1, wherein at least one pin of the two pins comprises:

at least one guide protrusion, each guide protrusion extending along a radial direction of the cylindrical body from the cylindrical body between the positioning part and the clamping protrusion; and a hole wall of the connecting hole is provided with a guide groove adapted to the guide protrusion.

3. The door body according to claim 2, wherein the at least one guide protrusion is a plurality of guide protrusions evenly distributed at intervals along the circumferential direction of the cylindrical body.

4. The door body according to claim 1, wherein an area on an outer surface of the storage box corresponding to the inner door is provided with at least one clamping groove; and an area of the inner door corresponding to the at least one clamping groove is provided with at least one fixing protrusion corresponding to and adapted to the at least one clamping groove one by one.

5. The door body according to claim 4, wherein the at least one clamping groove comprises two clamping grooves in opposite directions.

6. The door body according to claim 1, wherein the inner door comprises:

a door frame, a middle part of which defines an installation space; and a heat insulation board, arranged at the installation space, the storage box being fixed to a side of the heat insulation board close to the storage compartment.

7. A refrigerator, comprising:

a cabinet, in which a storage compartment with a compartment opening is defined; and a door body according to claim 1.

* * * * *